US011741889B2

(12) United States Patent
Lee et al.

(10) Patent No.: US 11,741,889 B2
(45) Date of Patent: Aug. 29, 2023

(54) DISPLAY DEVICE AND ELECTRONIC APPARATUS HAVING THE SAME

(71) Applicant: SAMSUNG DISPLAY CO., LTD., Yongin-si (KR)

(72) Inventors: Jang Mi Lee, Yongin-si (KR); Ki Hyun Pyun, Yongin-si (KR); Hyun Joo Seo, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/897,720

(22) Filed: Aug. 29, 2022

(65) Prior Publication Data

US 2023/0245615 A1 Aug. 3, 2023

(30) Foreign Application Priority Data

Feb. 3, 2022 (KR) ..... 10-2022-0014407

(51) Int. Cl.
*G09G 3/32* (2016.01)

(52) U.S. Cl.
CPC ..... *G09G 3/32* (2013.01); *G09G 2310/0267* (2013.01); *G09G 2310/0272* (2013.01); *G09G 2310/08* (2013.01); *G09G 2320/0257* (2013.01); *G09G 2320/0271* (2013.01); *G09G 2330/021* (2013.01)

(58) Field of Classification Search
CPC ..... G09G 3/32; G09G 2310/0267; G09G 2310/0272; G09G 2310/08; G09G 2320/0257; G09G 2320/0271; G09G 2330/021
See application file for complete search history.

(56) References Cited

U.S. PATENT DOCUMENTS

| | | | | |
|---|---|---|---|---|
| 9,153,161 | B1 * | 10/2015 | Byun | G09G 3/2007 |
| 9,530,380 | B2 | 12/2016 | Jang et al. | |
| 9,972,265 | B2 | 5/2018 | Na et al. | |
| 2003/0218432 | A1 * | 11/2003 | Song | G09G 3/2944 315/169.1 |
| 2005/0140640 | A1 * | 6/2005 | Oh | G09G 3/3406 345/102 |

(Continued)

FOREIGN PATENT DOCUMENTS

| | | | |
|---|---|---|---|
| KR | 102008912 | B1 | 8/2019 |
| KR | 102148482 | B1 | 8/2020 |

(Continued)

*Primary Examiner* — Michael J Jansen, II
(74) *Attorney, Agent, or Firm* — CANTOR COLBURN LLP

(57) ABSTRACT

A display device includes: a pixel component including pixels; a timing controller, which generates adjusted image data by converting grayscale values of input image data based on a gain value and generates first and second control signals control signal in response to an input control signal; a scan driver, which supplies a scan signal to the pixels in response to the first control signal; a data driver, which generates a data signal corresponding to the adjusted image data and supplies the data signal to the pixels based on the second control signal and the adjusted image data, and an image controller, which analyzes an input image in the input image data and gradually decreases the gain value during a first control period when the input image is a still image.

20 Claims, 9 Drawing Sheets

(56) References Cited

U.S. PATENT DOCUMENTS

| | | | | |
|---|---|---|---|---|
| 2007/0014541 | A1* | 1/2007 | Im | H04N 21/8153 348/E5.122 |
| 2009/0022395 | A1* | 1/2009 | Cho | G09G 5/06 382/167 |
| 2011/0298818 | A1* | 12/2011 | Mori | G09G 3/3208 345/589 |
| 2012/0113164 | A1* | 5/2012 | Furukawa | G09G 3/3648 345/102 |
| 2015/0332642 | A1* | 11/2015 | Mitsui | G09G 3/3607 345/694 |
| 2016/0140905 | A1* | 5/2016 | Yoo | G09G 3/3233 345/82 |
| 2017/0206834 | A1* | 7/2017 | Lee | G09G 3/3258 |
| 2018/0122300 | A1* | 5/2018 | Jang | G09G 3/3258 |
| 2020/0410942 | A1 | 12/2020 | Kim et al. | |
| 2021/0264877 | A1* | 8/2021 | Pyun | G09G 3/3233 |
| 2021/0327332 | A1* | 10/2021 | Choi | G09G 3/3208 |
| 2021/0335273 | A1* | 10/2021 | Meng | G09G 3/3208 |
| 2022/0198998 | A1* | 6/2022 | Park | G09G 3/2007 |

FOREIGN PATENT DOCUMENTS

| | | | |
|---|---|---|---|
| KR | 1020210000793 | A | 1/2021 |
| KR | 102293840 | B1 | 8/2021 |
| KR | 102312958 | B1 | 10/2021 |

* cited by examiner

HTa : HTa1, HTa2, HTa3, HTa4, HTa5
SP : SP1, SP2, SP3, SP4, SP5, SP6

HTa : HTa1, HTa2, HTa3, HTa4, HTa5
SP : SP1, SP2, SP3, SP5, SP6

DISPLAY DEVICE AND ELECTRONIC APPARATUS HAVING THE SAME

The application claims priority to Korean patent application number 10-2022-0014407, filed on Feb. 3, 2022, and all the benefits accruing therefrom under 35 U.S.C. § 119, the content of which in its entirety is herein incorporated by reference.

BACKGROUND

1. Technical Field

Various embodiments of the present disclosure relate to a display device and an electronic apparatus having the display device.

2. Related Art

A display device may include a plurality of pixels, and may display a frame through emission combination of the pixels. When a plurality of frames are continuously displayed, a user may recognize the frames as an image (a moving image or a still image).

The display device may prevent the occurrence of an afterimage and reduce power consumption by utilizing a screen saver function of decreasing the luminance of an image when a still image is displayed.

SUMMARY

Various embodiments of the present disclosure are directed to a display device that is capable of reducing power consumption and an electronic apparatus having the display device.

An embodiment of the present disclosure may provide for a display device. The display device includes: a pixel component including pixels; a timing controller, which generates adjusted image data by converting grayscale values of input image data based on a gain value and generates a first control signal and a second control signal in response to an input control signal, wherein the input image data and the input control signal is provided from an outside; a scan driver, which supplies a scan signal to the pixels in response to the first control signal; a data driver, which generates a data signal corresponding to the adjusted image data and supplies the data signal to the pixels based on the second control signal and the adjusted image data, and an image controller, which analyzes an input image in the input image data and gradually decreases the gain value from a value of an initial level to a value of a saturation level during a first control period when the input image is a still image. The image controller is configured to generate an output control signal for controlling the scan signal and the data signal to be supplied to the pixels in at least a partial period of the first control period.

In an embodiment, the scan driver may be configured to, in response to the output control signal, supply the scan signal, which has a turn-off level, to the pixels during the at least partial period of the first control period.

In an embodiment, the image controller may be configured to decrease the gain value in stages during the first control period.

In an embodiment, the first control period may include at least one step time point and at least one first hold period, and the gain value may decrease at the at least one step time point and may be maintained during the at least one first hold period.

In an embodiment, the scan driver may be configured to, in response to the output control signal, supply the scan signal, which has a turn-on level pulse, to the pixels in a frame corresponding to the at least one step time point, and to supply the scan signal, which is maintained at a turn-off level, to the pixels in a frame corresponding to the at least one first hold period.

In an embodiment, the first control signal may include a scan clock signal, and the scan clock signal may include the turn-on level pulse in the frame corresponding to the at least one step time point, and is maintained at the turn-off level in the frame corresponding to the at least one first hold period.

In an embodiment, the image controller may be configured to maintain the gain value at the value of the saturation level during a second control period after the first control period.

In an embodiment, the scan driver may be configured to, in response to the output control signal, supply the scan signal, which has a turn-off level to the pixels during the second control period.

In an embodiment, the scan driver may be configured to, in response to the output control signal, not supply the scan signal to the pixels in the at least partial period of the first control period.

In an embodiment, the data driver may be configured to, in response to the output control signal, supply an invalid data signal to the pixels during the at least partial period of the first control period.

In an embodiment, the data driver may be configured to, in response to the output control signal, not supply the data signal to the pixels during the at least partial period of in the first control period.

In an embodiment, the image controller may include: an image analyzer, which generates grayscale value information for the input image in the input image data, a gain value determiner, which generates a gain value determination signal based on the grayscale value information, a gain value generator, which generates the gain value in response to the gain value determination signal, and a output control signal generator, which generates the output control signal in response to the gain value determination signal.

In an embodiment, the image analyzer may be configured to detect, based on the input image data, whether the input image is a still image, and to further generate an enable signal when the input image is detected as the still image, and the gain value determiner may be configured to generate the gain value determination signal in response to the enable signal.

In an embodiment, the gain value determination signal may include information about the first control period, the value of the initial level, and the value of the saturation level.

In an embodiment, the image analyzer may include a first frame determiner, which extracts grayscale values for an input image of a first frame based on the input image data of the first frame, a second frame determiner, which extracts grayscale values for an input image of a second frame based on the input image data of the second frame, a frame comparator, which compares the grayscale values of the first frame and the grayscales values of the second frame with each other, and a still image detector, which detects whether the input image of the second frame is a still image based on a result of a comparison by the frame comparator.

An embodiment of the present disclosure may provide for an electronic apparatus. The electronic apparatus includes a processor, which outputs input image data and an input control signal through an interface, a pixel component including pixels, a timing controller, which generates adjusted image data by converting grayscale values of the input image data based on a gain value and generates a first control signal and a second control signal in response to the input control signal, a scan driver, which supplies a scan signal to the pixels in response to the first control signal, a data driver, which generates a data signal corresponding to the adjusted image data and supplies the data signal to the pixels based on the second control signal and the adjusted image data, and an image controller, which analyzes an input image in the input image data and gradually decrease the gain value from a value of an initial level to a value of a saturation level during a first control period when the input image is a still image. The image controller may be configured to generate a feedback signal for controlling output of the input image data and the input control signal from the processor in at least a partial period of the first control period.

In an embodiment, the processor may be configured, in response to the feedback signal, not to output the input image data and the control signal to the interface during the at least partial period of the first control period.

In an embodiment, the image controller may be configured to maintain the gain value at the value of the saturation level during a second control period after the first control period.

In an embodiment, the processor may be configured, in response to the feedback signal, not to output the input image data and the control signal to the interface during the second control period.

In an embodiment, the image controller may be configured to further generate an output control signal for controlling the scan signal and the data signal to be supplied to the pixels in the at least partial period of the first control period.

DETAILED DESCRIPTION

Figure 1:
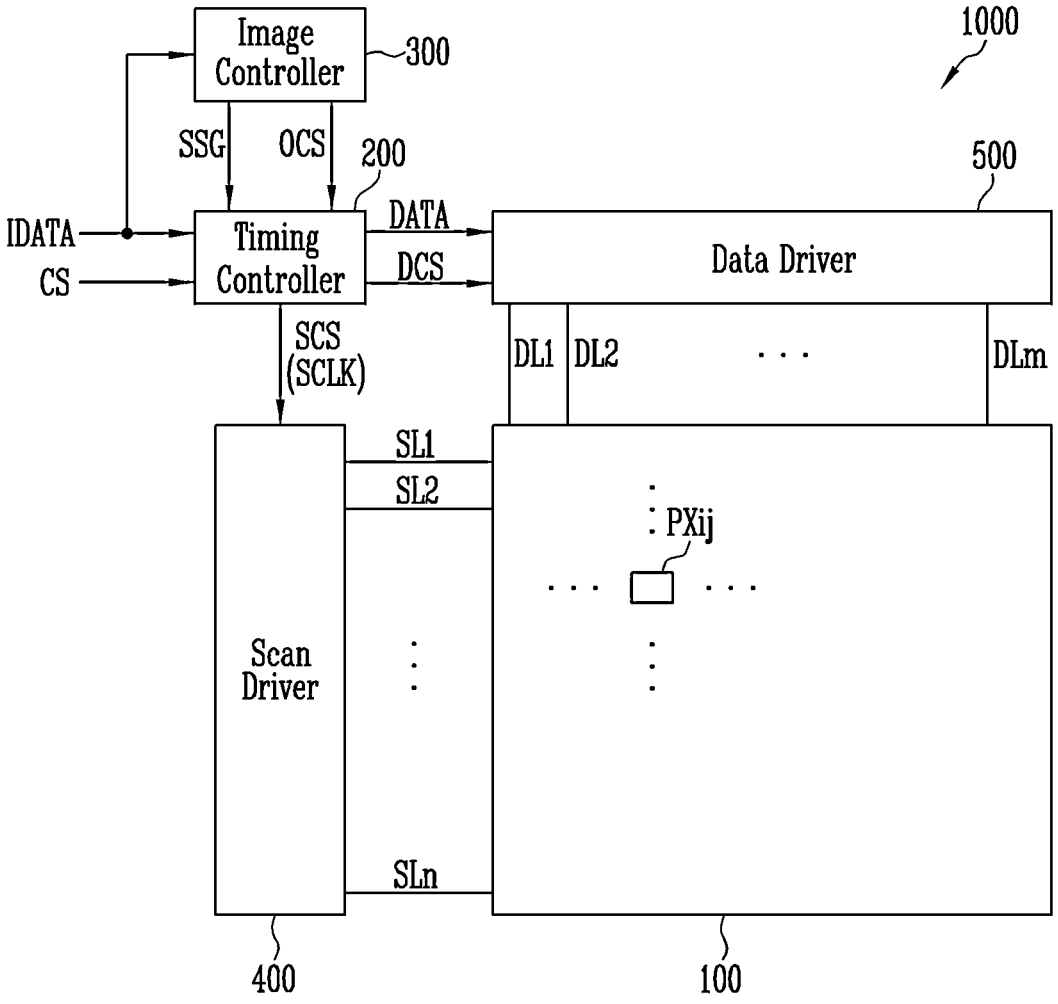
FIG. 1 is a block diagram illustrating a display device according to an embodiment of the present disclosure.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Hereinafter, embodiments of the present disclosure will be described in detail with reference to the accompanying drawings. The same reference numerals are used to designate the same or similar components throughout the drawings, and repeated descriptions thereof will be omitted.

FIG. 1 is a block diagram illustrating a display device according to an embodiment of the present disclosure.

Referring to FIG. 1, a display device 1000 may include a display panel 100, a timing controller 200, an image controller 300, a scan driver 400, and a data driver 500.

The display panel 100 (or pixel component) may include pixels PXij. Here, i and j may be integers greater than 0. Each pixel PXij may be coupled to a data line and a scan line that correspond to the pixel PXij. Here, the pixel PXij may refer to a pixel in which a scan transistor is coupled to an i-th scan line and a j-th data line.

The pixels PXij may be coupled to a first power line and a second power line. The pixels PXij may be supplied with a voltage of a first power source through the first power line, and may be supplied with a voltage of a second power source through the second power line. The voltage of the first power source and the voltage of the second power source may be the voltages for driving the pixels PXij, and the voltage level of the first power source may be higher than that of the second power source. For example, the voltage of the first power source may be a positive voltage, and the voltage of the second power source may be a negative voltage.

The timing controller 200 may receive input image data IDATA and an input control signal CS from an external processor. Here, the input control signal CS may include a synchronization signal, a clock signal, etc.

The timing controller 200 may generate a first control signal SCS (or a scan control signal) and a second control signal DCS (or a data control signal) in response to the input control signal CS. The timing controller 200 may provide the first control signal SCS to the scan driver 400, and may provide the second control signal DCS to the data driver 500.

The first control signal SCS may include a scan start signal, a scan clock signal SCLK, etc. The scan start signal may be a signal for controlling timing of a scan signal. The scan clock signal SCLK may be used to shift the scan start signal.

The second control signal DCS may include a source start signal, a data clock signal, etc. The source start signal may control a time point at which data sampling starts. The data clock signal may be used to control a sampling operation.

Also, the input image data IDATA may include grayscale values of an input image corresponding to at least one frame. For example, the input image data IDATA may include respective grayscale values of input images that are consecutive in each frame.

In an example, for a still image, grayscale values of input images that are consecutive in respective frames may be substantially the same as each other. In an example, for a moving image, grayscale values of input images that are consecutive in respective frames may be substantially different from each other.

The timing controller 200 may generate adjusted image data DATA based on the input image data IDATA, and may provide the adjusted image data DATA to the data driver 500.

The scan driver 400 may receive the first control signal SCS from the timing controller 200, and may supply scan signals to scan lines SL1 to SLn in response to the first control signal SCS. Here, n may be an integer greater than 0. For example, the scan driver 400 may sequentially supply scan signals, each having a turn-on level pulse, to the scan lines SL1 to SLn. For example, the scan driver 400 may include scan stages configured in the form of a shift register, and may generate scan signals using a scheme for sequentially transferring a scan start signal having the form of a turn-on level pulse to a subsequent scan stage under the control of the scan clock signal SCLK.

When scan signals having a turn-on level are sequentially supplied, the pixels PXij may be selected on a horizontal line basis (or a pixel row basis), and data signals may be supplied to the selected pixels PXij. For this operation, each scan signal having a turn-on level may be set to a gate-on voltage (a low voltage or a high voltage) so that a transistor that is included in each of the pixels PXij and receives the scan signal can be turned on.

The data driver 500 may receive the adjusted image data DATA and the second control signal DCS from the timing controller 200 and may supply data signals (or data voltages) corresponding to the adjusted image data DATA to the data lines DL1 to DLm in response to the second control signal DCS. Here, m may be an integer greater than 0. The data signals supplied to the data lines DL1 to DLm may be supplied to the pixels PXij selected by the scan signals. For this operation, the data driver 500 may supply the data signals to the data lines DL1 to DLm so that the data signals are synchronized with scan signals having a turn-on level.

The image controller 300 may generate a gain value SSG based on the input image data IDATA. For example, the gain value SSG may be a value that is equal to or greater than 0 and less than or equal to 1 (or a value that is equal to or greater than 0 percentage (%) and less than or equal to 100%). In addition, various other methods of representing the gain value SSG may be considered.

In an embodiment, the image controller 300 may establish a time point, at which a set period has elapsed since the time point at which an input image was detected as a still image, as a set time point (or set time), and may gradually decrease the gain value SSG from the set time point.

In an embodiment, for example, the image controller 300 may maintain the gain value SSG at the value of an initial level until the set time point, and may gradually decrease the gain value SSG during a first control period from the set time point to the time point at which the gain value SSG reaches the value of a saturation level. Also, the image controller 300 may maintain the gain value SSG during a second control period from the time point at which the gain value SSG reaches the value of the saturation level. Here, the second control period may be a period from a saturation time point to a reset time point, wherein the reset time point may correspond to the time point at which it is determined that the input image is no longer a still image.

In an embodiment, the image controller 300 may decrease the gain value SSG in stages. For example, the image controller 300 may decrease the gain value SSG in stages during the first control period from the value of the initial level to the value of the saturation level.

The image controller 300 may provide the gain value SSG to the timing controller 200.

The timing controller 200 may receive the gain value SSG from the image controller 300, and may convert the grayscale values of the input image data IDATA based on the gain value SSG. For example, the timing controller 200 may scale the grayscale values of the input image data IDATA using the gain value SSG. In an example, the timing controller 200 may convert the grayscale values of the input image data IDATA by multiplying the grayscale values by the gain value SSG.

The gain value SSG may be applied in common to all of the pixels PXij of the display panel 100. That is, the grayscale values of the input image data IDATA may be converted (e.g., scaled) at the same rate depending on the gain value SSG.

In an embodiment, the timing controller 200 may generate image data DATA based on the input image data IDATA, grayscale values of which are converted (e.g., scaled). For example, the timing controller 200 may generate the adjusted image data DATA by realigning the input image data IDATA, grayscale values of which are converted (e.g., scaled). The timing controller 200 may provide the adjusted image data DATA to the data driver 500.

Here, because the adjusted image data DATA is generated based on the input image data IDATA, grayscale values of which are converted depending on the gain value SSG, the data driver 500 may supply the data signals corresponding to the grayscale values converted depending on the gain value SSG to the data lines DL1 to DLm. Accordingly, the luminance of the image to be displayed on the display panel 100 (or by the pixels PXij) may be controlled in accordance with the converted grayscale values. For example, in accordance with the first control period in which the gain value SSG gradually decreases, the luminance of the displayed image gradually decreases, and during the second control period in which the gain value SSG is maintained, the luminance of the displayed image may be maintained at the decreased luminance. In this way, the display device 1000 (or the image controller 300) according to the embodiment of the present disclosure controls the luminance of the image to be displayed using the gain value SSG when the input image is detected as a still image, thus preventing the occurrence of an afterimage and reducing power consumption.

In an embodiment, the image controller 300 may generate an output control signal OCS, and may provide the output control signal OCS to the timing controller 200.

In an embodiment, the image controller 300 may generate the output control signal OCS for controlling scan signals to be supplied to the scan lines SL1 to SLn and/or data signals to be supplied to the data lines DL1 to DLm in at least a partial period included in the first control period (e.g., pCONa in FIG. 5A) during which the gain value SSG gradually decreases.

In an embodiment, for example, when the gain value SSC decreases in stages during the first control period, the gain value SSG may decrease at at least one step time point included in the first control period, and may be maintained during at least a first hold period included in the first control period. Here, because the gain value SSG is maintained during the at least first hold period included in the first control period, the luminance of the displayed image, which is a still image, may be maintained for the first hold period.

In an embodiment, the image controller 300 may generate the output control signal OCS for controlling scan signals to be supplied to the scan lines SL1 to SLn and/or data signals to be supplied to the data lines DL1 to DLm during the first hold period, in which the gain value SSG is maintained, in the first control period.

In an example, the timing controller 200 may control the scan driver 400 in response to the output control signal OCS so that the scan driver 400 does not supply scan signals to the scan lines SL1 to SLn during the first hold period included in the first control period.

In other examples, the timing controller 200 may control the scan driver 400 in response to the output control signal OCS so that the scan driver 400 supplies scan signals having a turn-off level (e.g., a gate-off voltage) to the scan lines SL1 to SLn during the first hold period included in the first control period. In an example, the timing controller 200 may provide the scan clock signal SCLK, maintained at a turn-off level, to the scan driver 400 during the first hold period included in the first control period in response to the output control signal OCS. Here, in response to the scan clock signal SCLK having a turn-off level, the scan driver 400 may supply scan signals having a turn-off level (e.g., a gate-off voltage) to the scan lines SL1 to SLn during the first hold period.

Accordingly, the amount of power consumed by the scan driver 400 to output scan signals may be reduced.

Here, because a display image displayed on the display panel 100 during the first hold period is a still image, and the luminance of the still image is maintained, a still image having the same luminance as the displayed still image may be displayed on the display panel 100 based on scan signals and data signals that have been supplied to the pixels PXij before the first hold period (e.g., in the frame just before the first hold period) even if scan signals are not provided to the scan lines SL1 to SLn or scan signals having a turn-off level are supplied to the scan lines SL1 to SLn.

Therefore, even if the output of the scan signals from the scan driver 400 is controlled during the first hold period, in which the gain value SSG is maintained, in the first control period, image quality may be maintained.

Further, in response to the output control signal OCS, the timing controller 200 may control a data signal supply operation by the data driver 500 during the first hold period included in the first control period.

In an example, the timing controller 200 may control the data driver 500 in response to the output control signal OCS so that the data driver 500 does not supply data signals to the data lines DL1 to DLm during the first hold period included in the first control period.

In other examples, the timing controller 200 may control the data driver 500 in response to the output control signal OCS so that the data driver 500 supplies invalid data signals to the data lines DL1 to DLm during the first hold period included in the first control period. Here, the invalid data signals may be data signals, each having a constant voltage level, regardless of the image to be displayed (e.g., a voltage level corresponding to a black data signal, or a low voltage level).

Here, as described above, scan signals are not supplied to the scan lines SL1 to SLn, or alternatively, scan signals having a turn-off level are supplied thereto, in response to the output control signal OCS during the first hold period. Accordingly, regardless of the voltage levels of the data signals supplied to the data lines DL1 to DLm, the display panel 100 (or the pixels PXij) may maintain the still image having a predetermined luminance (i.e., a luminance corresponding to data signals supplied to the pixels PXij in the frame just before the first hold period) during the first hold period using scan signals and data signals that were supplied to the pixels PXij before the first hold period (e.g., in the frame just before the first hold period).

Therefore, in response to the output control signal OCS, during the first hold period, the data driver 500 may not supply data signals to the data lines DL1 to DLm or may supply invalid data signals thereto, thus further reducing the amount of power consumed by the data driver 500.

In an embodiment, the image controller 300 may generate an output control signal OCS for controlling scan signals to be supplied to the scan lines SL1 to SLn and/or data signals to be supplied to the data lines DL1 to DLm at a second control period (or a second hold period) during which the gain value SSG is maintained.

In an embodiment, the image controller 300 may generate the output control signal OCS for controlling scan signals to be supplied to the scan lines SL1 to SLn and/or data signals to be supplied to the data lines DL1 to DLm during the second hold period in a manner substantially identical to that of the operation performed during the first hold period. Accordingly, power consumption incurred in the second hold period may be reduced.

The configuration in which the image controller 300 generates the gain value SSG and the output control signal OCS will be described in detail later with reference to FIGS. 3 to 8B.

Meanwhile, the image controller 300 may be implemented as a separate integrated circuit (IC) chip, together with the timing controller 200. However, the present disclosure is not limited thereto. In an example, all or part of the image controller 300 may be integrated with the timing controller 200 into an IC. In other examples, all or part of the image controller 300 may be implemented using software in the timing controller 200.

Figure 2:
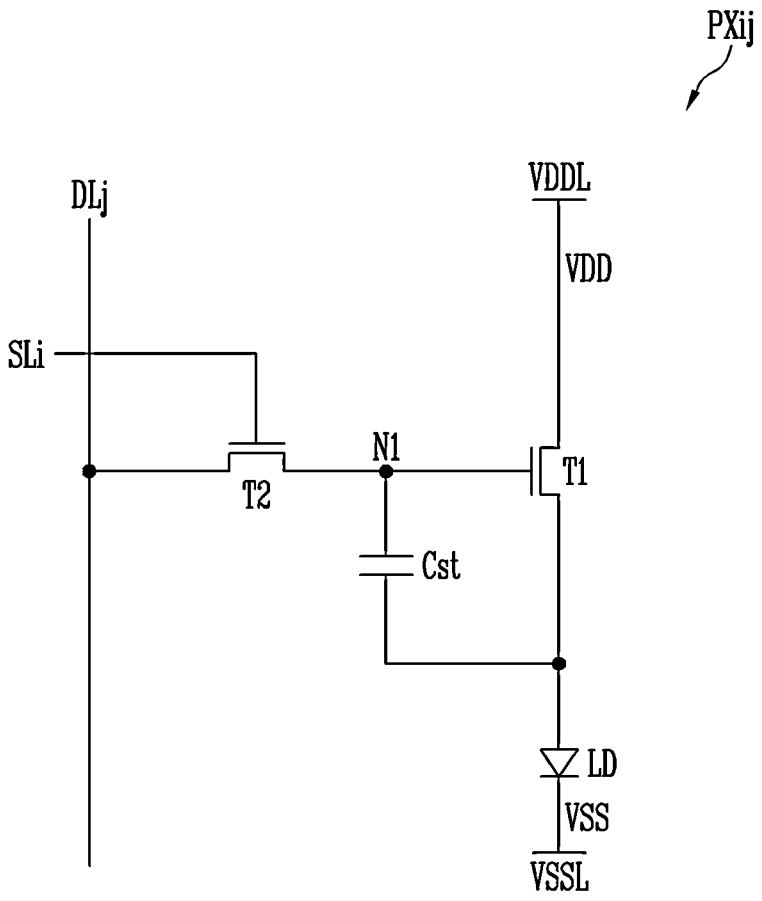
FIG. 2 is a circuit diagram illustrating an example of a pixel included in the display device of FIG. 1.

FIG. 2 is a circuit diagram illustrating an example of a pixel included in the display device of FIG. 1.

Referring to FIG. 2, the pixel PXij may include transistors T1 and T2, a storage capacitor Cst, and a light-emitting element LD.

Hereinafter, a circuit configured using N-type transistors will be described as an example. However, it is apparent that those skilled in the art may design a circuit configured using P-type transistors by varying the polarity of voltage that is applied to gate terminals of the transistors. Similarly, it is apparent that those skilled in the art will design a circuit using a combination of P-type transistors and N-type transistors. The term "P-type transistor" commonly designates a transistor through which an increased amount of current flows as a voltage difference between a gate electrode and a source electrode increases in a negative direction. The term "N-type transistor" commonly designates a transistor through which an increased amount of current flows as a voltage difference between a gate electrode and a source electrode increases in a positive direction. Each transistor may be implemented as any of various types of transistors, such as a thin film transistor (TFT), a field effect transistor (FET), and a bipolar junction transistor (BJT).

The first transistor T1 may be coupled between a first power line VDDL and a light-emitting element LD, and a gate electrode thereof may be coupled to a first node N1. The first transistor T1 may control the amount of current flowing from the first power line VDDL to a second power line VSSL via the light-emitting element LD in accordance with the voltage of the first node N1. The first transistor T1 may be referred to as a driving transistor.

The second transistor T2 may be coupled between a data line DLj and the first node N1, and a gate electrode thereof may be coupled to a scan line SLi. The second transistor T2 is turned on when a scan signal having a turn-on level is supplied to the scan line SLi, thus electrically connecting the data line DLj to the first node N1. Accordingly, a data signal may be transferred to the first node N1. The second transistor T2 may be referred to as a scan transistor.

The storage capacitor Cst may be coupled between the first node N1 corresponding to the gate electrode of the first transistor T1 and the second electrode of the first transistor T1. The storage capacitor Cst may store a voltage corresponding to a voltage difference between the gate electrode and the second electrode of the first transistor T1.

A first electrode (e.g., an anode electrode or a cathode electrode) of the light-emitting element LD may be coupled to the second electrode of the first transistor T1, and a second electrode (e.g., a cathode electrode or an anode electrode) of the light-emitting element LD may be coupled to the second power line VSSL. The light-emitting element LD may generate light having a certain luminance in accordance with the amount of current (or driving current) supplied from the first transistor T1.

As the light-emitting element LD, an organic light-emitting diode (LED) may be selected. Also, as the light-emitting element LD, an inorganic light-emitting diode (LED), such as a micro-LED or a quantum dot LED, may be selected. Further, the light-emitting element LD may be an element in which an organic material and an inorganic material are combined with each other. In FIG. 2, the pixel PXij is illustrated as including a single light-emitting element LD, but in other embodiments, the pixel PXij may include a plurality of light-emitting elements, which may be connected in series to each other, in parallel to each other, or in series-parallel to each other.

A voltage of a first power source VDD may be applied to the first power line VDDL, and a voltage of a second power source VSS may be applied to the second power line VSSL. That is, the voltage of the first power source VDD may be higher than the voltage of the second power source VSS.

When a scan signal having a turn-on level (e.g., a logic high level) is applied through the scan line SLi, the second transistor T2 may be turned on. Here, a voltage corresponding to the data signal applied to the data line DLj may be stored in the first node N1 (or the first electrode of the storage capacitor Cst).

A driving current corresponding to the voltage difference between the first electrode and the second electrode of the storage capacitor Cst may flow between the first electrode and the second electrode of the first transistor T1. Accordingly, the light-emitting element LD may emit light with a luminance corresponding to the data signal.

Meanwhile, the pixel PXij of FIG. 2 is only an example, and the embodiments of the present disclosure may also be applied to pixels of other circuits. For example, the pixel PXij may further include a transistor, which is turned on by further receiving an emission control signal, thus electrically connecting the second electrode of the first transistor T1 and the first electrode of the light-emitting element LD and/or the first electrode of the first transistor T1 and the first power line VDDL to each other. In addition, the pixel PXij may further include a sensing transistor, which is turned on in response to a sensing signal supplied through a separate sensing line, thus sensing a voltage or current applied to the second electrode of the first transistor T1 or the first electrode of the light-emitting element LD and transferring the sensed voltage or current to the sensing line.

Meanwhile, as described above with reference to FIG. 1, when a scan signal having a turn-off level (e.g., a gate-off voltage) is supplied to the scan line SLi during a first hold period and/or a second hold period, the second transistor T2 may remain turned off during the first hold period and/or the second hold period. In this case, a voltage corresponding to the data signal (e.g., the data signal applied through the data line DLj in the frame just before the first hold period and/or the second hold period) stored in the first node N1 (or the first electrode of the storage capacitor Cst) may be maintained by the storage capacitor Cst.

Here, as described above, the second transistor T2 may be an N-type oxide transistor. For example, the second transistor T2 may include an oxide semiconductor layer as an active layer (semiconductor layer or channel layer).

An oxide semiconductor transistor enables a low-temperature process, and has charge mobility lower than that of a polysilicon semiconductor transistor. That is, the oxide semiconductor transistor has excellent off-current characteristics. Therefore, when the second transistor T2 is implemented as an oxide semiconductor transistor, a leakage current through the second transistor T2 may be minimized during the first hold period and/or the second hold period, and thus the voltage of the data signal stored in the first node N1 may remain stable during the first hold period and/or the second hold period, with the result that display quality may be improved.

Figure 3:
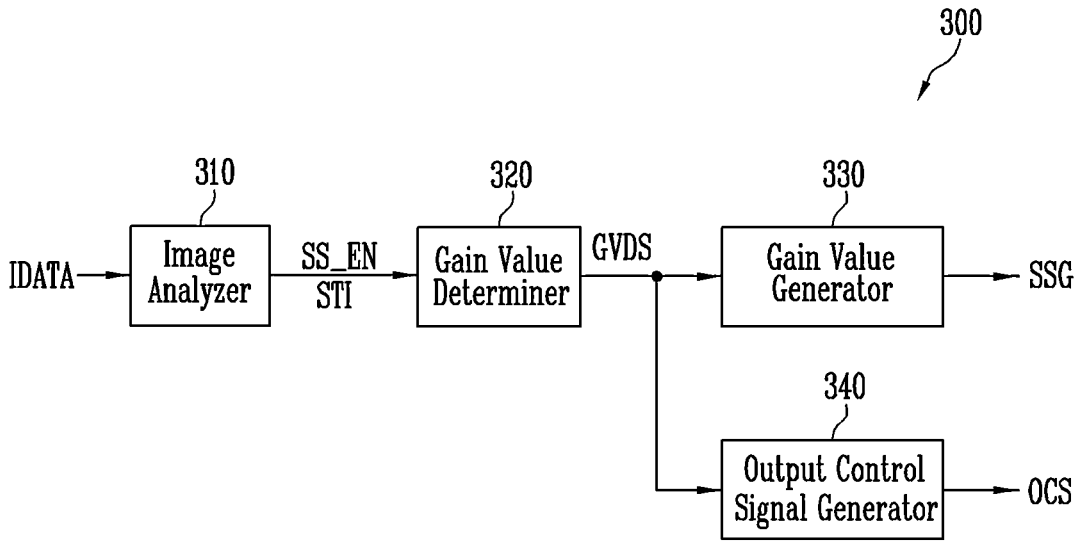
FIG. 3 is a block diagram illustrating an image controller according to an embodiment of the present disclosure.
Figure 4:
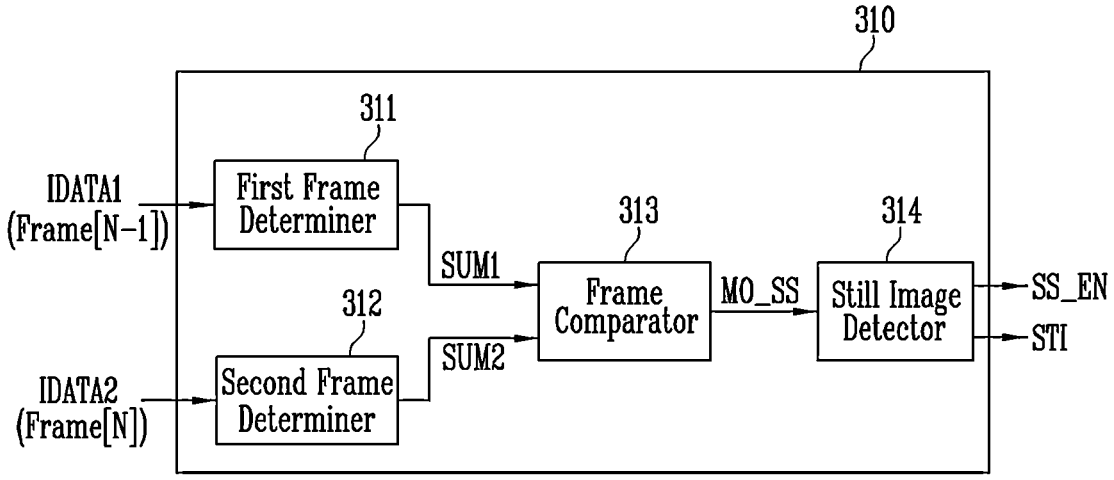
FIG. 4 is a block diagram illustrating an example of an image analyzer included in the image controller of FIG. 3.

FIG. 3 is a block diagram illustrating the image controller according to an embodiment of the present disclosure. FIG. 4 is a block diagram illustrating an example of an image analyzer included in the image controller of FIG. 3.

Referring to FIG. 3, the image controller 300 according to an embodiment of the present disclosure may include an image analyzer 310, a gain value determiner 320, a gain value generator 330, and an output control signal generator 340.

The image analyzer 310 may analyze whether an input image corresponding to input image data IDATA is a still image or a moving image using the input image data IDATA, and may output an enable signal SS_EN when the input image is detected as a still image. Here, the enable signal SS_EN may be a signal that enables the image controller 300, described above with reference to FIG. 1, to activate an operation of controlling a gain value SSG (or an operation of controlling the luminance of an image to be displayed) when the input image data IDATA is the still image.

Referring further to FIG. 4 to describe in detail the image analyzer 310, the image analyzer 310 may compare gray-scale values of input image data (e.g., first input image data IDATA1) corresponding to a previous frame (e.g., an N−1-th frame Frame[N−1], where N is an integer greater than '1') with grayscale values of input image data (e.g., second input image data IDATA2) corresponding to the current frame (e.g., an N-th frame Frame[N]), and may then detect whether the input image of the input image data (or second input image data IDATA2) corresponding to the current frame Frame[N] is a still image.

When the input image of the input image data corresponding to the current frame Frame[N] is a still image, the image analyzer 310 may generate and output an enable signal SS_EN for activating the operation of controlling the gain value SSG and grayscale value information STI for the input image that is the still image.

For this operation, in an embodiment, the image analyzer 310 may include a first frame determiner 311, a second frame determiner 312, a frame comparator 313, and a still image detector 314.

The first frame determiner 311 may extract the grayscale values SUM1 of an input image in the previous frame Frame [N−1] (or the first frame) based on the first input image data IDATA1 in the previous frame Frame [N−1].

Similarly, the second frame determiner 312 may extract the grayscale values SUM2 of an input image in the current frame Frame [N] (or the second frame) based on the second input image data IDATA2 in the current frame Frame [N].

The frame comparator 313 may receive the grayscale values SUM1 and SUM2 of the previous frame Frame[N−1] and the current frame Frame[N] from the first and second frame determiners 311 and 312, may compare the grayscale values SUM1 of the previous frame Frame[N−1] with the grayscale values SUM2 of the current frame Frame[N], and may extract a difference value MO_SS between the grayscale values SUM1 of the previous frame Frame[N−1] and the grayscale values SUM2 of the current frame Frame[N].

The still image detector 314 may detect whether the input image of the current frame Frame [N] is a still image, based on the difference value MO_SS between the grayscale values SUM1 of the previous frame Frame[N−1] and the grayscale values SUM2 of the current frame Frame[N], which is received from the frame comparator 313. For example, the still image detector 314 may detect that the input image is a still image if the difference value MO_SS between the grayscale values SUM1 of the previous frame Frame[N−1] and the grayscale values SUM2 of the current frame Frame[N] is less than or equal to a reference value.

However, the present disclosure is not limited thereto, and the image analyzer 310 may also detect whether the input image is a still image using, for example, a conventional still image detection algorithm.

Meanwhile, although, in FIG. 4, the image analyzer 310 has been described as comparing the grayscale values of two frames (i.e., the previous frame Frame[N−1] and the current frame Frame[N]) with each other, embodiments of the present disclosure are not limited thereto. For example, the image analyzer 310 may also detect whether the input image is a still image by comparing grayscale values of three or more frames with each other in another embodiment.

When the input image is detected as a still image, the still image detector 314 may generate and output the enable signal SS_EN and grayscale value information STI for the input image that is the still image. Here, the grayscale value information STI may include information about the grayscale values of the input image corresponding to the input image data of the current frame Frame[N]. For example, the grayscale value information STI may include the average of the grayscale values of the input image corresponding to the input image data of the current frame Frame[N].

Referring back to FIG. 3, the image analyzer 310 may provide the enable signal SS_EN and the grayscale value information STI to the gain value determiner 320.

When the enable signal SS_EN is received, an operation of generating a gain value determination signal GVDS for controlling the gain value SSG by the gain value determiner 320 may be activated.

In an embodiment, the gain value determiner 320 may generate the gain value determination signal GVDS based on the grayscale value information STI. Here, the gain value determination signal GVDS may include information for controlling the gain value SSG.

In an embodiment, for example, the gain value determination signal GVDS may include information about an enable time point, a set time point, the initial level value of the gain value SSG, and the saturation level value of the gain value SSG, which are described with reference to FIG. 1.

In an embodiment, the gain value determiner 320 may generate the gain value determination signal GVDS in such a way as to establish a set period to be shorter as the grayscale values of the input image are greater, based on the grayscale value information STI. For example, the gain value determiner 320 may establish the set period to be shorter as the average of the grayscale values of the input image is greater. The set period corresponding to the average of the grayscale values of the input image may be prestored in the gain value determiner 320 in the form of a look-up table or the like, or may be calculated using an algorithm.

In an embodiment, for example, when the set time point is established to appear faster (i.e., when the set period is established to be shorter), luminance change may be visually perceived by a user, whereas when the set time point is established to appear slower (i.e., when the set period is established to be longer), a problem may arise in that the effect of afterimage prevention and reduction of power consumption may be decreased, and thus there is a need to establish a suitable set time point. Here, because, as the condition in which the grayscale values of an input image, which is a still image (or the average of the grayscale values), are greater, it is more disadvantageous with regard to afterimage prevention and power consumption, the gain value determiner 320 may establish the set period to be shorter as the average of the grayscale values of the input image is greater.

However, the embodiment of the present disclosure is not limited thereto, and the gain value determiner 320 may establish the set period to have various lengths in accordance with the grayscale values of the input image. In an example, the gain value determiner 320 may establish the set period to be uniform regardless of the grayscale values of the input image.

In an embodiment, the gain value determiner 320 may determine the saturation level of the gain value SST based on the grayscale value information STI. For example, the gain value determiner 320 may determine the saturation level in accordance with the average of the grayscale values of an input image corresponding to a still image. Here, the saturation level of the gain value SSG corresponding to the average of the grayscale values may be preset, and may be prestored in the gain value determiner 320 in the form of a look-up table.

Also, as illustrated with reference to FIG. 1, during the first control period, the image controller 300 may decrease the gain value SSG in stages from the value of an initial level to the value of a saturation level, and the gain value determination signal GVDS may include information about a step time point, at which the gain value SSG decreases, in the first control period, and information about a first hold period, in which the gain value SSG is maintained, in the first control period, in accordance with the decreased gain value SSG. Also, the gain value determination signal GVDS may further include information about a saturation time point at which the gain value SSG reaches the value of the saturation level.

The gain value determination signal GVDS generated by the gain value determiner 320 may be provided both to the gain value generator 330 and to the output control signal generator 340.

In an embodiment, the gain value generator 330 may generate the gain value SSG in response to the gain value determination signal GVDS.

In an embodiment, for example, the gain value generator 330 may generate the gain value SSG using information included in the gain value determination signal GVDS. For example, the gain value generator 330 may generate the gain value SSG using information about the enable time point, the set time point, the initial level value of the gain value SSG, and the saturation level value of the gain value SSG and information about the step time point and the first hold period.

The operation in which the gain value generator 330 generates the gain value SSG will be described in detail later with reference to FIGS. 5A and 5B.

In an embodiment, the output control signal generator 340 may generate the output control signal OCS in response to the gain value determination signal GVDS.

In an embodiment, for example, the output control signal generator 340 may generate the output control signal OCS using information included in the gain value determination signal GVDS.

In an embodiment, for example, the output control signal generator 340 may generate the output control signal OCS for controlling scan signals to be supplied to the scan lines SL1 to SLn and/or data signals to be supplied to the data lines DL1 to DLm during the first control period, in response to the gain value determination signal GVDS.

In an embodiment, for example, the output control signal generator 340 may generate the output control signal OCS for controlling scan signals so that the scan signals are not supplied to the scan lines SL1 to SLn during the first hold period in which the gain value SSG is maintained, in the first control period. Further, the output control signal generator 340 may also generate the output control signal OCS for controlling scan signals so that the scan signals having a turn-off level are supplied to the scan lines SL1 to SLn during the first hold period.

Further, the output control signal generator 340 may generate the output control signal OCS for controlling data signals so that the data signals are not supplied to the data lines DL1 to DLm during the first hold period, in which the gain value SSG is maintained, in the first control period. Furthermore, the output control signal generator 340 may generate the output control signal OCS for controlling data signals so that invalid data signals are supplied to the data lines DL1 to DLm during the first hold period.

Here, at the step time point, at which the gain value SSG decreases, in the first control period, the grayscale values of the input image data IDATA are converted in response to the gain value SSG, and thus the data signals generated based on the adjusted image data DATA are converted. Accordingly, the output control signal generator 340 may generate the output control signal OCS for controlling scan signals and data signals so that the scan signals supplied to the scan lines SL1 to SLn and data signals supplied to the data lines DL1 to DLm at the step time point (or in a frame corresponding to the step time point) are output normally.

Furthermore, the output control signal generator 340 may generate the output control signal OCS for controlling scan signals to be supplied to the scan lines SL1 to SLn and/or data signals to be supplied to the data lines DL1 to DLm during a second hold period (or a second control period) using information about the saturation time point. Here, the configuration in which the output control signal generator 340 generates the output control signal OCS at the second hold period may be substantially identical or similar to the configuration in which the output control signal generator 340 generates the output control signal OCS at the first hold period.

The operation in which the output control signal generator 340 generates the output control signal OCS will be described in detail later with reference to FIGS. 6, 7A, 7B, 8A, and 8B.

Figure 5A:
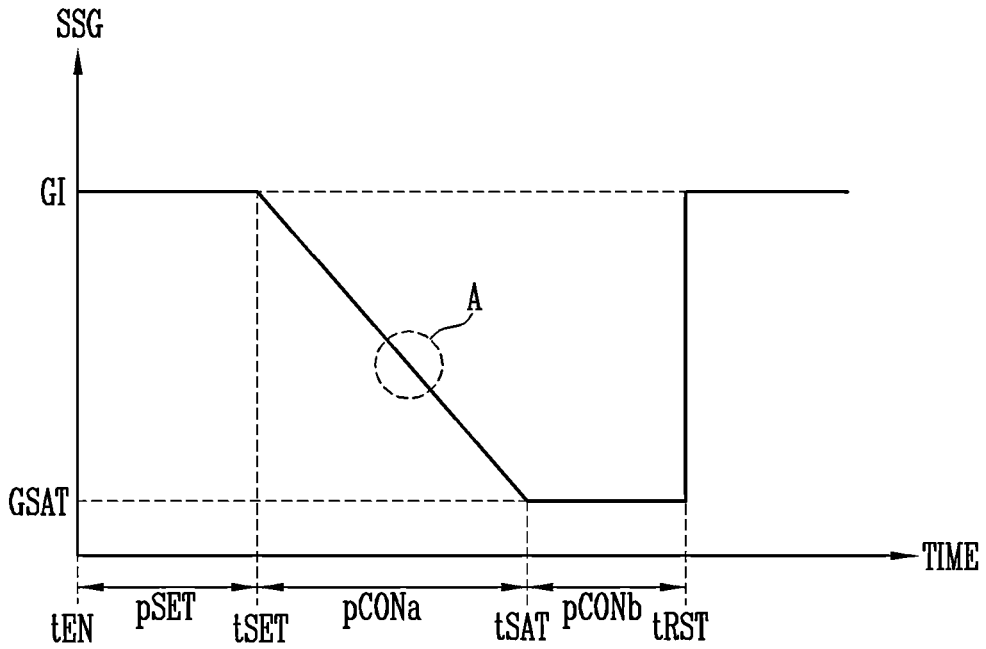
FIGS. 5A and 5B are diagrams for explaining an example of operation of the image controller of FIG. 3.
Figure 5B:
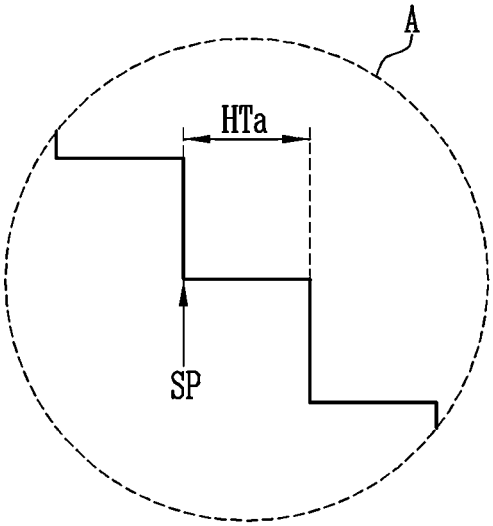

FIGS. 5A and 5B are diagrams for explaining an example of operation of the image controller of FIG. 3. Here, a graph of gain values SSG over time is illustrated in FIG. 5A, and an enlarged graph of portion A in FIG. 5A is illustrated in FIG. 5B.

Referring to FIGS. 3, 5A, and 5B, an enable time point tEN may be a time point at which an input image is detected as a still image. When the input image is detected as a still image, a screen saver function of preventing the occurrence of an afterimage and reducing power consumption by decreasing the luminance of an image using a gain value SSG may be enabled, as described above with reference to FIGS. 1, 3, and 4. The gain value SSG at the enable time point tEN may have the value of an initial level GI.

The gain value determiner 320 may generate a gain value determination signal GVDS by establishing a time point at which a set period pSET has elapsed from the enable time point tEN as a set time point tSET. For example, the gain value determiner 320 may generate the gain value determination signal GVDS by establishing the set period corresponding to the average of grayscale values of the input image, based on grayscale value information STI.

The gain value determiner 320 may determine the value of the saturation level GSAT of the gain value SST based on the grayscale value information STI. For example, the gain value determiner 320 may determine the value of the saturation level GSAT in accordance with the average of the grayscale values of the input image.

Here, as illustrated in FIG. 5B, the gain value SSG may be decreased in stages. For example, the gain value SSG may decrease at a step time point SP included in a first control period pCONa, and may be maintained during a first hold period HTa included in the first control period pCONa.

For this operation, the gain value determiner 320 may determine the step time point SP, at which the gain value SSG decreases, and the first hold period HTa, in which the gain value SSG is maintained, in the first control period pCONa, and may then generate the gain value determination signal GVDS. Here, in order for the gain value SSG to decrease in stages and then reach the saturation level GSAT from the initial level GI, the first control period pCONa may include a plurality of step time points SP and a plurality of first hold periods HTa.

The image controller 300 (or the gain value generator 330) may gradually decrease the gain value SSG during the first control period pCONa from the corresponding set time point tSET to the corresponding saturation time point tSAT. For example, the image controller 300 (or the gain value generator 330) may decrease the gain value SSG from the value of the initial level GI to the value of the saturation level GSAT in stages during the first control period pCONa in response to the grayscale value determination signal GVDS.

The saturation time point tSAT may be a time point at which the gain value SSG reaches the saturation level GSAT.

The image controller 300 (or the gain value generator 330) may maintain the gain value SSG during a second control period pCONb from the saturation time point tSAT.

A reset time point tRST may be a time point at which it is determined that the input image is no longer a still image. For example, this may indicate the case where a still image corresponding to all or part of the input image is changed to another still image or to a moving image. Here, the image controller 300 may return the gain value SSG to the initial level GI. For example, the image controller 300 may determine that all or part of the input image is not a still image based on the input image data IDATA, and may generate the gain value SSG having the value of the initial level GI in accordance with the result of the determination.

Figure 6:
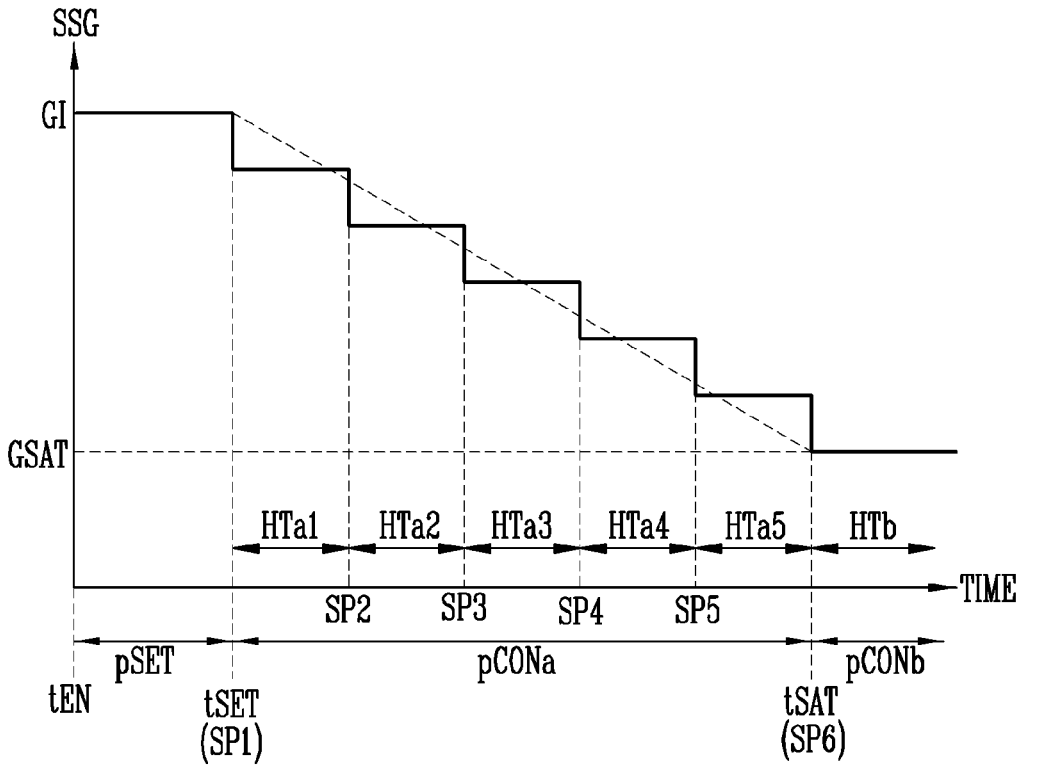
FIG. 6 is a diagram for explaining an example of operation of the image controller of FIG. 3.
Figure 6:
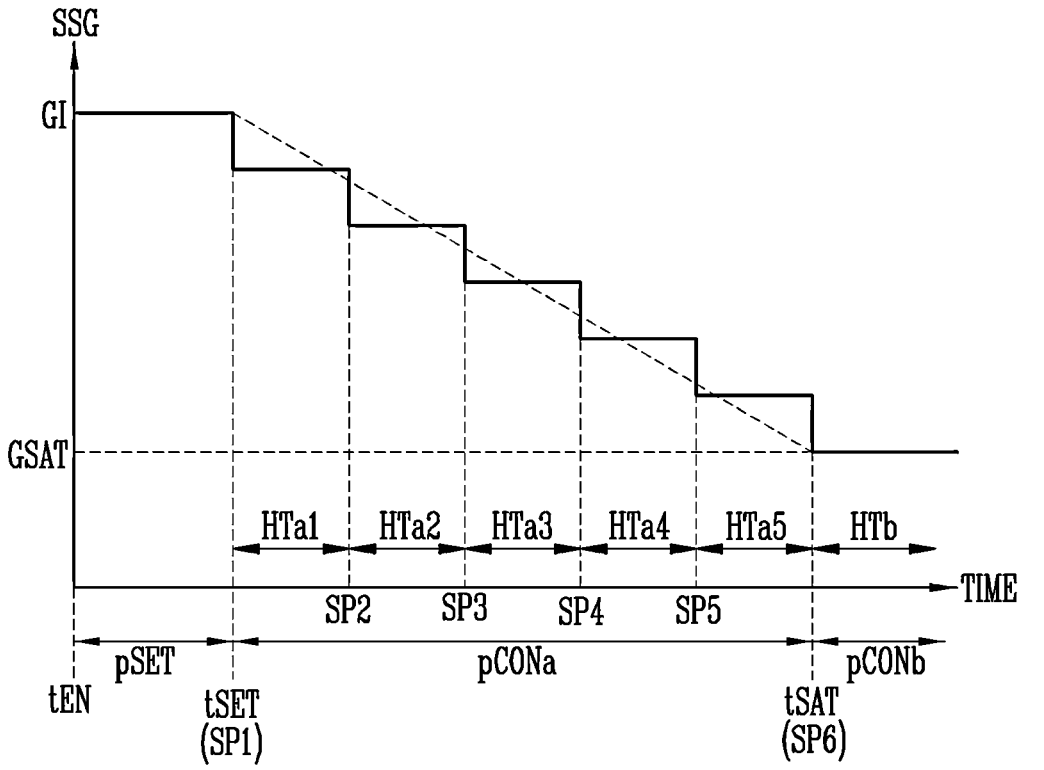
Figure 7A:
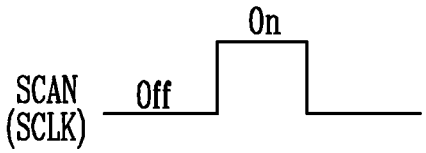
FIGS. 7A and 7B are waveform diagrams for explaining an example of a scan signal (scan clock signal) controlled by the image controller of FIG. 3.
Figure 7B:
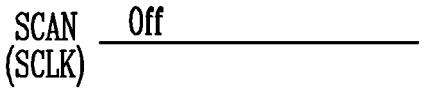
Figure 8A:
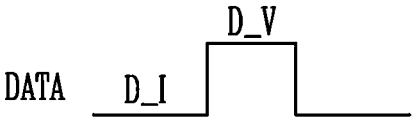
FIGS. 8A and 8B are waveform diagrams for explaining an example of a data signal controlled by the image controller of FIG. 3.
Figure 8B:
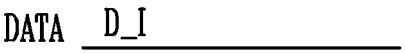

FIG. 6 is a diagram for explaining an example of operation of the image controller of FIG. 3. FIGS. 7A and 7B are waveform diagrams for explaining an example of a scan signal (scan clock signal) controlled by the image controller of FIG. 3. FIGS. 8A and 8B are waveform diagrams for explaining an example of a data signal controlled by the image controller of FIG. 3.

Similar to FIGS. 5A and 5B, FIG. 6 shows a graph of gain values SSG over time. For convenience of description, although a first control period pCONa is illustrated as including six step time points SP1, SP2, SP3, SP4, SP5, and SP6 and five first hold periods HTa1, HTa2, HTa3, HTa4, and HTa5 in FIG. 6, this configuration is only an example, and the number of step time points SP and the number of first hold periods HTa included in the first control period pCONa may be set to various values.

Further, a waveform diagram of a scan signal SCAN (or a scan clock signal SCLK) corresponding to the step time point SP (e.g., a frame corresponding to the step time point SP) included in the first control period pCONa is illustrated in FIG. 7A, and a waveform diagram of a scan signal SCAN (or a scan clock signal SCLK) corresponding to the first hold period HTa included in the first control period pCONa and/or a second control period pCONb (or a second hold period HTb) is illustrated in FIG. 7B.

Similarly, a waveform diagram of a data signal DATA corresponding to the step time point SP (e.g., a frame corresponding to the step time point SP) included in the first control period pCONa is illustrated in FIG. 8A, and a waveform diagram of a data signal DATA corresponding to the first hold period HTa included in the first control period pCONa and/or the second control period pCONb (or the second hold period HTb) is illustrated in FIG. 8B.

Referring to FIGS. 1, 2, 3, 5A, 5B, and 6, the gain value SSG may decrease in stages during the first control period pCONa. For example, as described above with reference to FIGS. 3, 5A, and 5B, the gain value SSG decreases at step time points SP (e.g., first to sixth step time points SP1, SP2, SP3, SP4, SP5, and SP6) included in the first control period pCONa, and may be maintained during the first hold periods HTa (e.g., 1-1-th to 1-5-th hold periods HTa1, HTa2, HTa3, HTa4, and HTa5) included in the first control period pCONa. Also, the gain value SSG may be maintained during the second control period pCONb (or the second hold period HTb).

Here, as described above with reference to FIGS. 1 and 3, during the first control period pCONa and the second control period pCONb, a scan signal SCAN (or a scan clock signal SCLK) and/or a data signal DATA may be controlled in response to the output control signal OCS.

In an embodiment, for example, referring further to FIGS. 7A and 8A, in a frame corresponding to the step time point SP included in the first control period pCONa, each of scan signals SCAN supplied to scan lines SL1 to SLn may have a turn-on level pulse (indicated by 'On'). For example, a scan start signal is shifted in response to the scan clock signal SCLK having a turn-on level pulse, and then a scan signal SCAN having a turn-on level pulse may be provided to the pixel PXij through the corresponding scan line. In response to the scan signal SCAN having a turn-on level pulse, a transistor (e.g., the second transistor T2 of FIG. 2), which is included in the pixel PXij and receives the scan signal SCAN, may be turned on, and the data signal DATA supplied to the data line may be written to the pixel PXij. For example, the data signal DATA having a voltage corresponding to valid data D_V may be written to the pixel PXij. For example, the gain value SSG may decrease at the step time point SP included in the first control period pCONa, and the grayscale values of the input image data IDATA are converted depending on the decreased gain value SSG. A data signal DATA (e.g., a data signal DATA generated based on input image data IDATA, the grayscale value of which is reduced compared to a previous frame) having a voltage corresponding to valid data D_V converted based on the adjusted image data IDATA, may be supplied to the pixel PXij.

Furthermore, referring further to FIG. 7B, during the first hold period HTa (e.g., in frames corresponding to the first hold period HTa) included in the first control period pCONa, scan signals SCAN may not be supplied to the scan lines SL1 to SLn, or alternatively, scan signals SCAN supplied to the scan lines SL1 to SLn may be maintained at a turn-off level (indicated by 'Off'). For example, each scan signal SCAN may be maintained at a turn-off level in response to the scan clock signal SCLK maintained at a turn-off level, and thus the scan signal SCAN having a turn-off level may be provided to the pixel PXij through the corresponding scan line. Accordingly, the amount of power consumed by the scan driver 400 (see FIG. 1) required to output scan signals SCAN may be further reduced.

Here, in response to a scan signal SCAN having a turn-off level, a transistor (e.g., the second transistor T2 of FIG. 2), which receives the scan signal SCAN and is included in the pixel PXij, may remain turned off. Accordingly, as described above with reference to FIG. 2, a voltage corresponding to the data signal stored in the pixel PXij during the first hold period HTa (e.g., a data signal applied in the frame just before the first hold period HTa) may be maintained. Therefore, a still image having the same luminance may be displayed during the first hold period HTa.

Further, as described above with reference to FIG. 1, when a scan signal SCAN is not supplied to a scan line or when a scan signal SCAN having a turn-off level is supplied to the scan line, a still image having the same luminance may be displayed during the first hold period HTa using scan signals SCAN and data signals DATA which have been supplied to the pixels PXij before the first hold period HTa (e.g., in the frame just before the first hold period HTa), regardless of the voltage levels of the data signals DATA supplied to the data lines DL1 to DLm.

Therefore, referring further to FIG. 8B, during the first hold period HTa, even if data signals DATA are not supplied to the data lines DL1 to DLm or data signals DATA having a voltage corresponding to invalid data D_I are supplied thereto, a still image having the same luminance may be displayed during the first hold period HTa. Further, because data signals DATA are not supplied to the data lines DL1 to DLm or data signals DATA having a voltage corresponding to invalid data D_I are supplied thereto during the first hold period HTa, the amount of power consumed by the data driver 500 may be further decreased.

Meanwhile, although, in FIGS. 7B and 8B, a description has been made based on scan signals SCAN and data signals DATA during the first hold period HTa, scan signals SCAN and data signals DATA during the second hold period HTb may also be controlled in a manner substantially identical to that in the first hold period HTa.

As described above with reference to FIGS. 1 to 8B, the display device 1000 (or the image controller 300) according to embodiments of the present disclosure may further reduce power consumption by controlling scan signals SCAN and/or data signals DATA at the first hold period HTa and the second hold period HTb while performing a screen saver function of preventing the occurrence of an afterimage and reducing power consumption by decreasing the luminance of an image using a gain value SSG depending on whether an input image is a still image.

Figure 9:
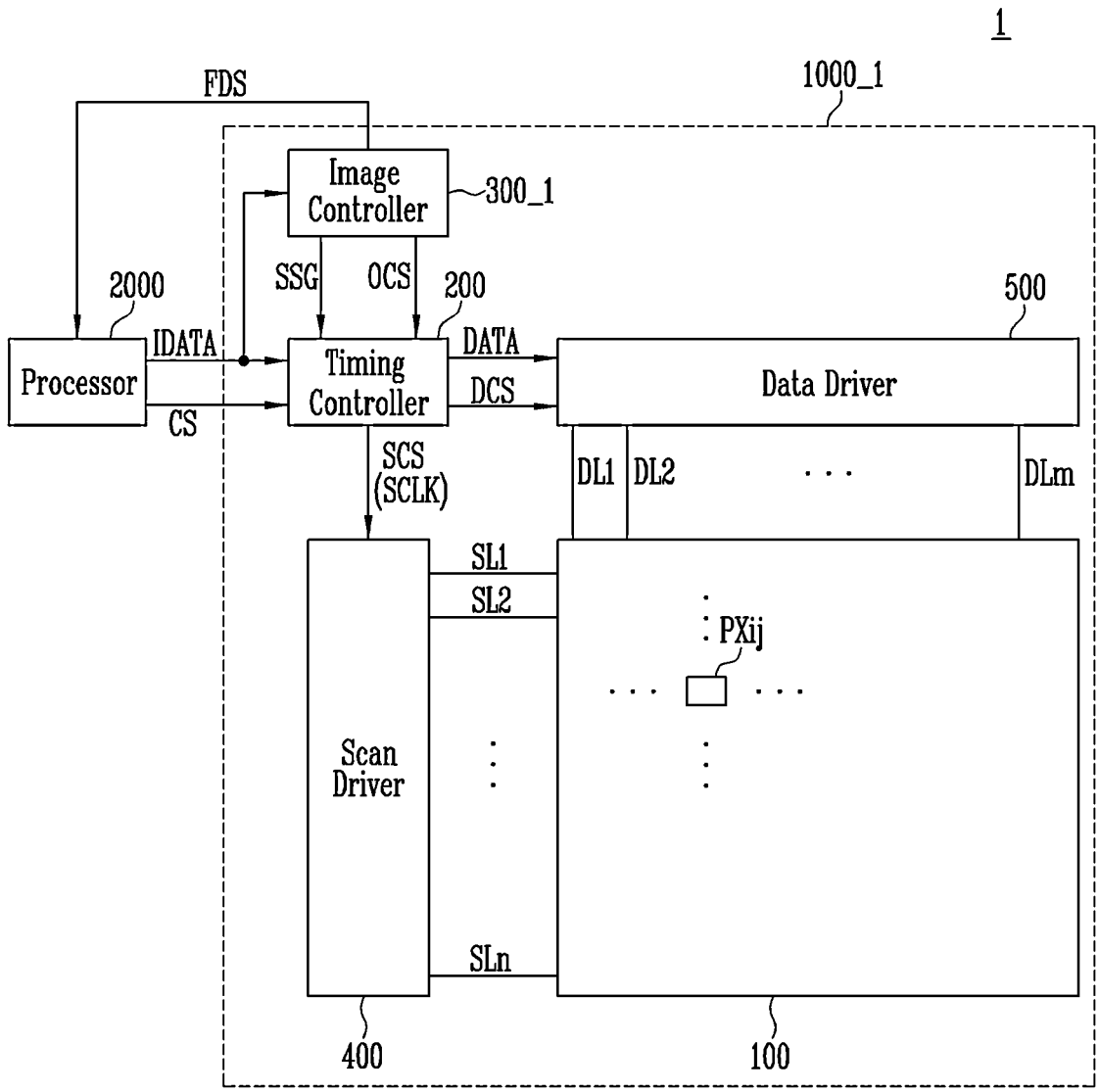
FIG. 9 is a block diagram illustrating an electronic apparatus according to an embodiment of the present disclosure.
Figure 10:
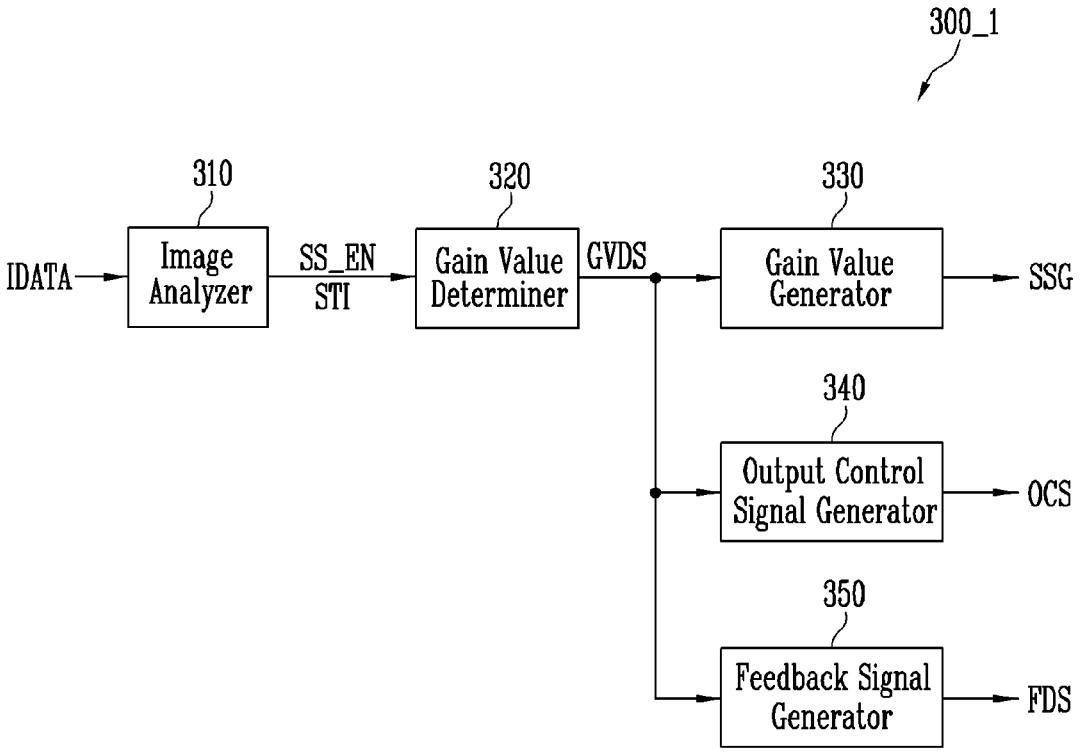
FIG. 10 is a block diagram illustrating an image controller according to another embodiment of the present disclosure.

FIG. 9 is a block diagram illustrating an electronic apparatus according to an embodiment of the present disclosure. FIG. 10 is a block diagram illustrating the image controller according to an embodiment of the present disclosure.

Referring to FIG. 9, an electronic apparatus 1 may include a display device 1000_1 and a processor 2000.

The display device 1000_1 may include a display panel 100, a timing controller 200, an image controller 300_1, a scan driver 400, and a data driver 500.

Here, since the display device 1000_1 and the image controller 300_1 of FIG. 9 are substantially identical or similar to the display device 1000 and the image controller 300, respectively, described to above with reference to FIGS. 1 and 3, except that the image controller 300_1 further generates a feedback signal FDS, repeated descriptions thereof will be omitted.

The processor 2000 may provide input image data IDATA and an input control signal CS to the timing controller 200 through a preset interface.

In an embodiment, the image controller 300_1 may generate the feedback signal FDS and provide the feedback signal FDS to the processor 2000.

In an example, referring further to FIG. 10, the image controller 300_1 may include an image analyzer 310, a gain value determiner 320, a gain value generator 330, an output control signal generator 340, and a feedback signal generator 350.

The feedback signal generator 350 may receive a gain value determination signal GVDS, and may generate the feedback signal FDS based on the gain value determination signal GVDS. For example, the feedback signal generator 350 may detect a first hold period HTa (see FIG. 6) included in a first control period pCONa (see FIG. 6) and a second control period pCONb (see FIG. 6) (or a second hold period HTb (see FIG. 6)) in response to the gain value determination signal GVDS. The feedback signal generator 350 may generate the feedback signal FDS for controlling the processor 2000 so that the processor 2000 does not output the input image data IDATA and the input control signal CS during the first hold period HTa (see FIG. 6) and the second hold period HTb (see FIG. 6).

The processor 2000 may not provide the input image data IDATA and the input control signal CS to the timing controller 200 during the first hold period HTa (see FIG. 6) and the second hold period HTb (see FIG. 6) in response to the feedback signal FDS. Accordingly, power consumption incurred by transmission/reception of signals between the processor 2000 and the display device 1000 (or the timing controller 200) may be further reduced.

Here, as described above with reference to FIGS. 1 to 8B, during the first hold period HTa (see FIG. 6) and the second hold period HTb (see FIG. 6), scan signals to be supplied to the scan lines SL1 to SLn and/or data signals to be supplied to the data lines DL1 to DLm are controlled. Accordingly, even if the input image data IDATA and the input control signal CS are not provided from the processor 2000 to the timing controller 200, a still image that is previously displayed (e.g., displayed in a frame before the first hold period HTa (see FIG. 6) and/or in a frame before the second hold period HTb (see FIG. 6)) is displayed on the display panel 100, and thus it is possible to maintain the quality of the displayed image.

A display device and an electronic apparatus having the display device according to embodiments of the present disclosure may perform a screen saver function of preventing the occurrence of an afterimage and reducing power consumption by decreasing the luminance of an image depending on whether an input image is a still image while further reducing power consumption by controlling a scan signal and/or a data signal during a hold period.

As used in connection with various embodiments of the disclosure, each of the image analyzer 310, the gain value determiner 320, the gain value generator 330, the output control signal generator 340, the first frame determiner 311, the second frame determiner 312, the frame comparator 313, and the still image detector 314 may be implemented in hardware, software, or firmware, for example, implemented in a form of an application-specific integrated circuit (ASIC).

However, the advantages of the present disclosure are not limited to the foregoing advantages, and various other advantages may be obtained without departing from the spirit and scope of the present disclosure.

Although the embodiments of the present disclosure have been described, those skilled in the art will appreciate that the present disclosure may be modified and changed in various forms without departing from the spirit and scope of the present disclosure as claimed in the accompanying claims.

What is claimed is:

1. A display device, comprising:

a pixel component including pixels;

a timing controller, which generates adjusted image data by converting grayscale values of input image data based on a gain value and generates a first control signal and a second control signal in response to an input control signal, wherein the input image data and the input control signal is provided from an outside;

a scan driver, which supplies a scan signal to the pixels in response to the first control signal;

a data driver, which generates a data signal corresponding to the adjusted image data and supplies the data signal to the pixels based on the second control signal and the adjusted image data; and an image controller, which analyzes an input image in the input image data and gradually decreases the gain value from a value of an initial level to a value of a saturation level during a first control period when the input image is a still image, wherein the image controller is configured to generate an output control signal for controlling the scan signal and the data signal to be supplied to the pixels in at least a partial period of the first control period.

2. The display device according to claim 1, wherein the scan driver is configured to, in response to the output control signal, supply the scan signal, which has a turn-off level, to the pixels during the at least partial period of the first control period.

3. The display device according to claim 1, wherein the image controller is configured to decrease the gain value in stages during the first control period.

4. The display device according to claim 3, wherein:

the first control period includes at least one step time point and at least one first hold period, and the gain value decreases at the at least one step time point, and is maintained during the at least one first hold period.

5. The display device according to claim 4, wherein the scan driver is configured to, in response to the output control signal, supply the scan signal, which has a turn-on level pulse, to the pixels in a frame corresponding to the at least one step time point, and to supply the scan signal, which is maintained at a turn-off level, to the pixels in a frame corresponding to the at least one first hold period.

6. The display device according to claim 5, wherein:

the first control signal includes a scan clock signal, and the scan clock signal includes the turn-on level pulse in the frame corresponding to the at least one step time point, and is maintained at the turn-off level in the frame corresponding to the at least one first hold period.

7. The display device according to claim 1, wherein the image controller is configured to maintain the gain value at the value of the saturation level during a second control period after the first control period.

8. The display device according to claim 7, wherein the scan driver is configured to, in response to the output control signal, supply the scan signal, which has a turn-off level, to the pixels during the second control period.

9. The display device according to claim 1, wherein the scan driver is configured to, in response to the output control signal, not supply the scan signal to the pixels in the at least partial period of the first control period.

10. The display device according to claim 2, wherein the data driver is configured to, in response to the output control signal, supply an invalid data signal to the pixels during the at least partial period of the first control period.

11. The display device according to claim 2, wherein the data driver is configured to, in response to the output control signal, not supply the data signal to the pixels during the at least partial period of in the first control period.

12. The display device according to claim 1, wherein the image controller comprises:

an image analyzer, which generates grayscale value information for the input image in the input image data;

a gain value determiner, which generates a gain value determination signal based on the grayscale value information;

a gain value generator, which generates the gain value in response to the gain value determination signal; and an output control signal generator, which generates the output control signal in response to the gain value determination signal.

13. The display device according to claim 12, wherein:

the image analyzer is configured to detect, based on the input image data, whether the input image is a still image, and to further generate an enable signal when the input image is detected as the still image, and the gain value determiner is configured to generate the gain value determination signal in response to the enable signal.

14. The display device according to claim 12, wherein the gain value determination signal includes information about the first control period, the value of the initial level, and the value of the saturation level.

15. The display device according to claim 12, wherein the image analyzer comprises:

a first frame determiner, which extracts grayscale values for an input image of a first frame based on the input image data of the first frame;

a second frame determiner, which extracts grayscale values for an input image of a second frame based on the input image data of the second frame;

a frame comparator, which compares the grayscale values of the first frame and the grayscale values of the second frame with each other; and a still image detector, which detects whether the input image of the second frame is a still image based on a result of a comparison by the frame comparator.

16. An electronic apparatus, comprising:

a processor, which outputs input image data and an input control signal through an interface;

a pixel component including pixels;

a timing controller, which generates adjusted image data by converting grayscale values of the input image data based on a gain value and generates a first control signal and a second control signal in response to the input control signal;

a scan driver, which supplies a scan signal to the pixels in response to the first control signal;

a data driver, which generates a data signal corresponding to the adjusted image data and supplies the data signal to the pixels based on the second control signal and the adjusted image data; and an image controller, which analyzes an input image in the input image data and gradually decreases the gain value from a value of an initial level to a value of a saturation level during a first control period when the input image is a still image, wherein the image controller is configured to generate a feedback signal for controlling output of the input image data and the input control signal from the processor in at least a partial period of the first control period.

17. The electronic apparatus according to claim 16, wherein the processor is configured, in response to the feedback signal, not to output the input image data and the control signal to the interface during the at least partial period of the first control period.

18. The electronic apparatus according to claim 16, wherein the image controller is configured to maintain the gain value at the value of the saturation level during a second control period after the first control period.

19. The electronic apparatus according to claim 18, wherein the processor is configured, in response to the feedback signal, not to output the input image data and the control signal to the interface during the second control period.

20. The electronic apparatus according to claim 16, wherein the image controller is configured to further generate an output control signal for controlling the scan signal and the data signal to be supplied to the pixels in the at least partial period of the first control period.

* * * * *